US011065507B2

(12) United States Patent
Liu et al.

(10) Patent No.: US 11,065,507 B2
(45) Date of Patent: Jul. 20, 2021

(54) MULTIFUNCTIONAL BALANCE EXERCISE MACHINE

(71) Applicant: JIAN LING TECHNOLOGY CO., LTD., Taoyuan (TW)

(72) Inventors: Chen-Ya Liu, Taoyuan (TW); Chin-Yuan Liu, Taoyuan (TW)

(73) Assignee: Jian Ling Technology Co., Ltd., Taoyuan (TW)

( * ) Notice: Subject to any disclaimer, the term of this patent is extended or adjusted under 35 U.S.C. 154(b) by 52 days.

(21) Appl. No.: 16/565,729

(22) Filed: Sep. 10, 2019

(65) Prior Publication Data

US 2020/0101352 A1 Apr. 2, 2020

(30) Foreign Application Priority Data

Sep. 28, 2018 (TW) ..... 107213231

(51) Int. Cl.

| | |
|---|---|
| ***A63B 26/00*** | (2006.01) |
| ***A63B 22/18*** | (2006.01) |
| ***A63B 71/06*** | (2006.01) |
| ***A63B 69/18*** | (2006.01) |

(52) U.S. Cl.

CPC ..... *A63B 26/003* (2013.01); *A63B 22/18* (2013.01); *A63B 71/0619* (2013.01); *A63B 69/18* (2013.01); *A63B 2071/0647* (2013.01)

(58) Field of Classification Search

CPC ... A63B 26/003; A63B 22/18; A63B 71/0619; A63B 69/18; A63B 2071/0647; A63B 23/04; A63B 23/02; A63B 71/06; A63B 22/16

See application file for complete search history.

(56) References Cited

U.S. PATENT DOCUMENTS

2014/0162852 A1* 6/2014 Ho ..... A63B 21/4033 482/127
2018/0193693 A1* 7/2018 Youm ..... G01L 5/00

FOREIGN PATENT DOCUMENTS

TW M577327 * 9/2018 ..... A63B 22/16

OTHER PUBLICATIONS

TWM577327 Machine Translation (Year: 2020).*

* cited by examiner

*Primary Examiner* — Nyca T Nguyen
*Assistant Examiner* — Andrew M Kobylarz
(74) *Attorney, Agent, or Firm* — Rosenberg, Klein & Lee

(57) ABSTRACT

A multifunctional balance exercise machine comprises a balancing mechanism including loading board, spring, elastic column, and motion-tracking sensor; a first display unit and an electronic control device loaded with motion sensor game program arranged on the exercise equipment; whereby when the fitness user stands on the loading board, the user body weight and the stress applied by feet transmit to the elastic column and the spring via the loading board, cause the elastic column and the spring compressed or stretched, and force the loading board to oscillate, then achieve the effect of balance exercise; furthermore, the motion tracking sensor transmit signal of oscillation data to electronic control device, the processor unit operates the data, and present the image of the motion sensor game via the first display unit to achieve entertaining effect of virtual reality game.

9 Claims, 10 Drawing Sheets

MULTIFUNCTIONAL BALANCE EXERCISE MACHINE

BACKGROUND OF THE INVENTION

1. Field of the Invention

The invention relates to a multifunctional balance exercise machine, especially to one that includes a balancing mechanism arranged at the top of a base frame of an exercise equipment; the balancing mechanism includes a loading board, a spring, an elastic column and a motion-tracking sensor; a first display unit and a processor unit loaded with motion sensing game program are arranged on the exercise equipment; whereby when the fitness user stand on the loading board, the user body weight and the stress applied by feet transmit to the elastic column and the spring via the loading board causing the elastic column and spring compressed or stretched, and force the loading board to oscillate then achieve the effect of balance exercise, and the motion-tracking sensor transmit signal of oscillation data to the wireless receiving unit, the processor unit operate the data, and present the image of the motion sensor game via the first display unit to achieve entertaining effect of virtual reality game.

2. Description of the Related Art

The present invention relates to an exercise equipment, especially one arranged with the spring and the motion-tracking sensor and connected to the electronic control device loaded with motion sensing game program to achieve the effect of balance exercise or entertaining effect of virtual reality game.

People in modern society always live a fast-paced life, and there isn't enough time for outdoor exercise, most people can only do indoor exercise with exercise equipment instead.

Currently, most of the exercise machines design is based on imitating outdoor exercise, such as treadmills, rowing machine, exercise bicycle, etc; These machines are using users movement of imitating relative exercise to drive driven part or using exercise machines owned character of mechanical movement motivate user to twist their body to achieve the effect of fitness exercise.

Recently, there has been a new type of fitness machine that simulates surfing and skiing, the fitness machine comprises a frame, spring, and a loading board, when fitness user stands on the loading board, the user's weight and stress he applies to the loading board cause the spring and the loading board oscillating, and while user tries to keep balance on the oscillating loading board achieves effect fitness with imitating surfing or skiing.

Above mentioned the fitness machine that simulates surfing and skiing has spring fix on the loading board via fixing plate directly, so the fitness machine cannot provide enough space between the spring and the loading board during exercise, thus, it decreases flexibility of the loading board. Furthermore, virtual reality game is popular now, if one can combine skiing or surfing virtual reality game with oscillating of the loading board to enhance entertaining effect, the additional value of the fitness machine will be increased.

SUMMARY OF THE INVENTION

It is a primary objective of the present invention to provide a multifunctional balance exercise machine with better flexibility of the loaded board oscillating which is closer to the skiing or surfing.

It is another objective of the present invention to provide a multifunctional balance exercise that can connect to the virtual reality game to enhance entertaining effect.

In order to achieve the above objectives, the multifunctional balance exercise includes an exercise equipment, a balancing mechanism, and an electronic control device; wherein the exercise equipment has a base frame, at the front side extends upwards with a vertical bar, a grab rail is arranged symmetrically on both sides of the vertical bar, and a handle is arranged symmetrically on the upper end of the vertical bar; the balancing mechanism has a fixing base arranged on the base frame, a spring arranged on the fixing base, a lower supporting plate arranged on the top of the spring, an upper supporting plate connected with a pivoting center mechanism arranged above the lower supporting plate, multiple elastic column fixed between a stress loading plate and the upper supporting plate by the bolt, a motion-tracking sensor with build-in signal controlling and transmitting device, the motion-tracking sensor arranged at the upper edge of the upper supporting plate, and a loading board arranged above the stress loading plate; the electronic control device has a power control unit, a first display unit, a wireless receiving unit, and a processor unit loaded with motion sensing game program, the electronic control device arranged on the horizontal lever of the handle.

Whereby when the fitness user stand on the loading board, the user body weight and the stress applied by feet transmit to the elastic column and the spring via the loading board causing the elastic column and spring compressed or stretched, and force the loading board to oscillate then achieve the effect of balance exercise; furthermore, the motion tracking sensor transmit signal of oscillation data to the wireless receiving unit, the processor unit operate the data, and present the image of the motion sensor game via the first display unit to achieve entertaining effect of virtual reality game.

Furthermore, in the present invention has a guiding pin which is capable of having radial displacement on the lower supporting plate, on the edge of the upper supporting plate arranged a limit slot, and a steering slot, the distance between the limit slot and the steering slot is 180 angular degree, embedding the guiding pin to the limit slot stops the upper supporting plate and the lower supporting plate from pivoting, and embedding the guiding pin to the steering slot have the upper supporting plate and the lower supporting plate pivoting repeatedly in predetermined angular degree.

Moreover, the pivoting center mechanism in the present invention includes a central axis arranged at the lower supporting plate, a pivot hinge arranged at the outer edge of the central axis makes the upper supporting board fix on the pivot hinge, so the as to pivot; the pivot hinge has a damper making the upper supporting plate endure resistant force in order to enhance the effect of fitness exercise.

Moreover, in the present invention, the damper includes two brake clamps, two brake calipers, and an adjuster, the two brake clamps arranged on the lower supporting plate, the two brake calipers arranged inside of the two brake clamps and covered the pivot hinge, the adjuster is arranged on the two brake clamps, by adjusting the two brake clamps to change the tightness of the two brake calipers produce different resistance force while the upper supporting plate is pivoting to enhance the effect of fitness exercise.

As state above, the benefits of the multifunctional balance exercise machine comprising:

a) In the present invention, the balancing mechanism includes the loading board, under the loading board arranged spring and multiple elastic column; the fitness user needs to apply stress and weight on the loading board to keep in balance, by affect from the compressed or stretched of the multiple elastic column, provide flexibility for loading board to do torsional movement, and improve the effect of imitating skiing or surfing.

b) In the present invention, the balancing mechanism has a steering slot and a limit slot arranged 180° apart from each other, on the lower supporting plate set a guiding pin which is capable of having radial displacement on the lower supporting plate, the fitness user can either embed the guiding pin to the limit slot to stop the upper supporting plate and the lower supporting plate from pivoting, and achieve the effect of simulating the up and down motion of the surfing, or embed the guiding pin to the steering slot to have the upper supporting plate and the lower supporting plate pivoting repeatedly in predetermined angular degree, and achieve the effect of simulating the up and down and oscillating motion of the skiing.

c) In the present invention, the balancing mechanism has a motion-tracking sensor with build-in signal sensor and transmitter, an electronic control device arranged on the horizontal lever of the handle, the electronic control device includes a power control unit, a first display unit, a wireless receiving unit, and a processor unit loaded with skiing or surfing motion sensing game program; therefore, when the fitness user does balance exercise on the loading board, the motion tracking sensor transmit signal of oscillation data to the processor unit, after operating the data, present the image of the motion sensor game via the first display unit to achieve entertaining effect of virtual reality game.

DETAILED DESCRIPTION OF THE PREFERRED EMBODIMENT

Figure 1:
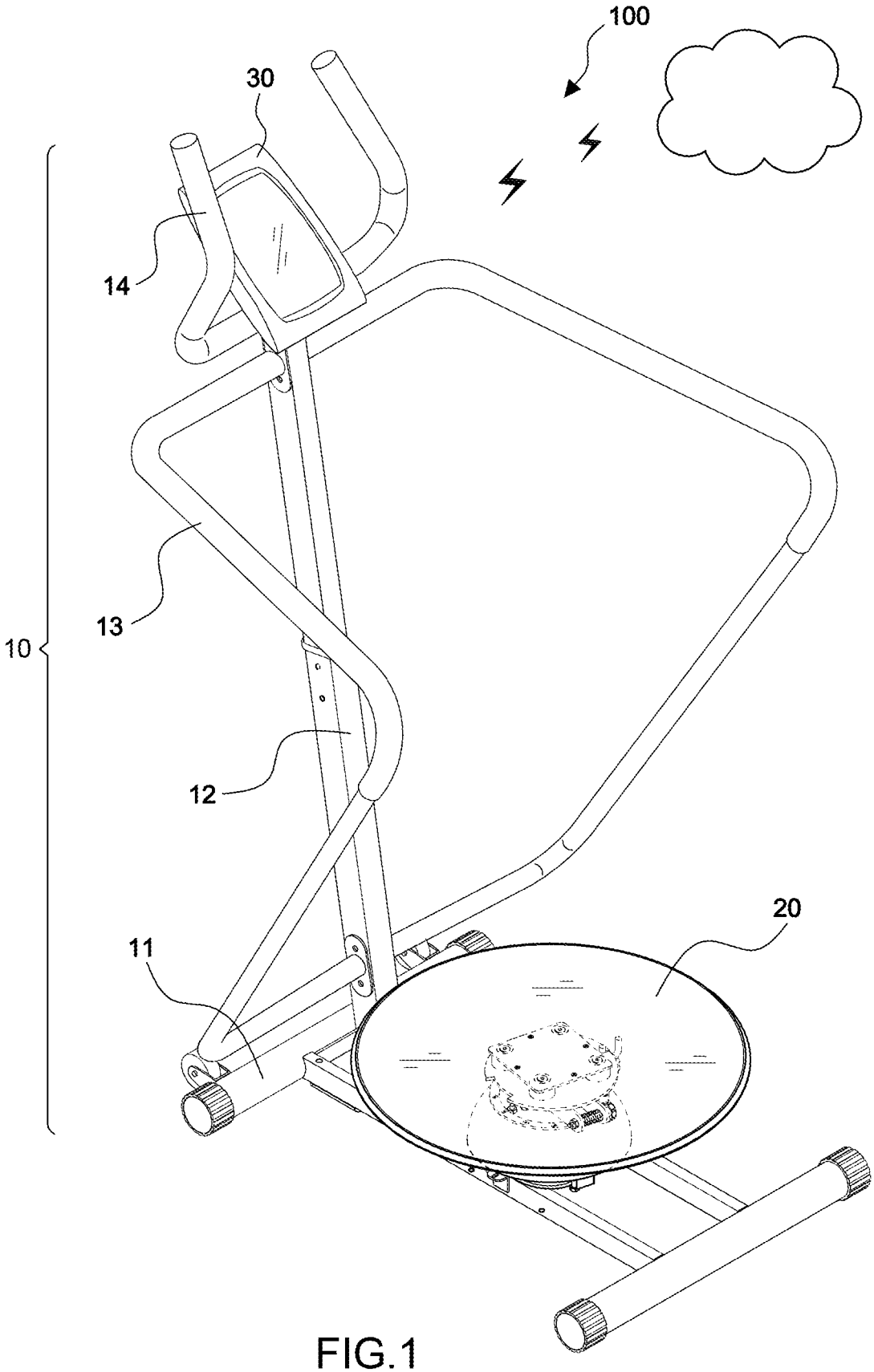
FIG. 1 is an assembly perspective views of multifunctional balance exercise machine in the present invention.

Referring to FIG. 1, in the present invention, the multifunctional balance exercise machine 100 comprising an exercise equipment 10, a balancing mechanism 20, and electronic control device 30; wherein the exercise equipment 10 has a base frame 11 for making the multifunctional balance exercise machine 100 place firmly on the ground, at the front side extends upwards with a vertical bar 12, a grab rail 13 is arranged symmetrically on the both sides of the vertical bar 12 worked as protection when users lose their balance, and a handle 14 is arranged symmetrically on the upper end of the vertical bar 12 worked as auxiliary device of keeping balance.

Figure 2:
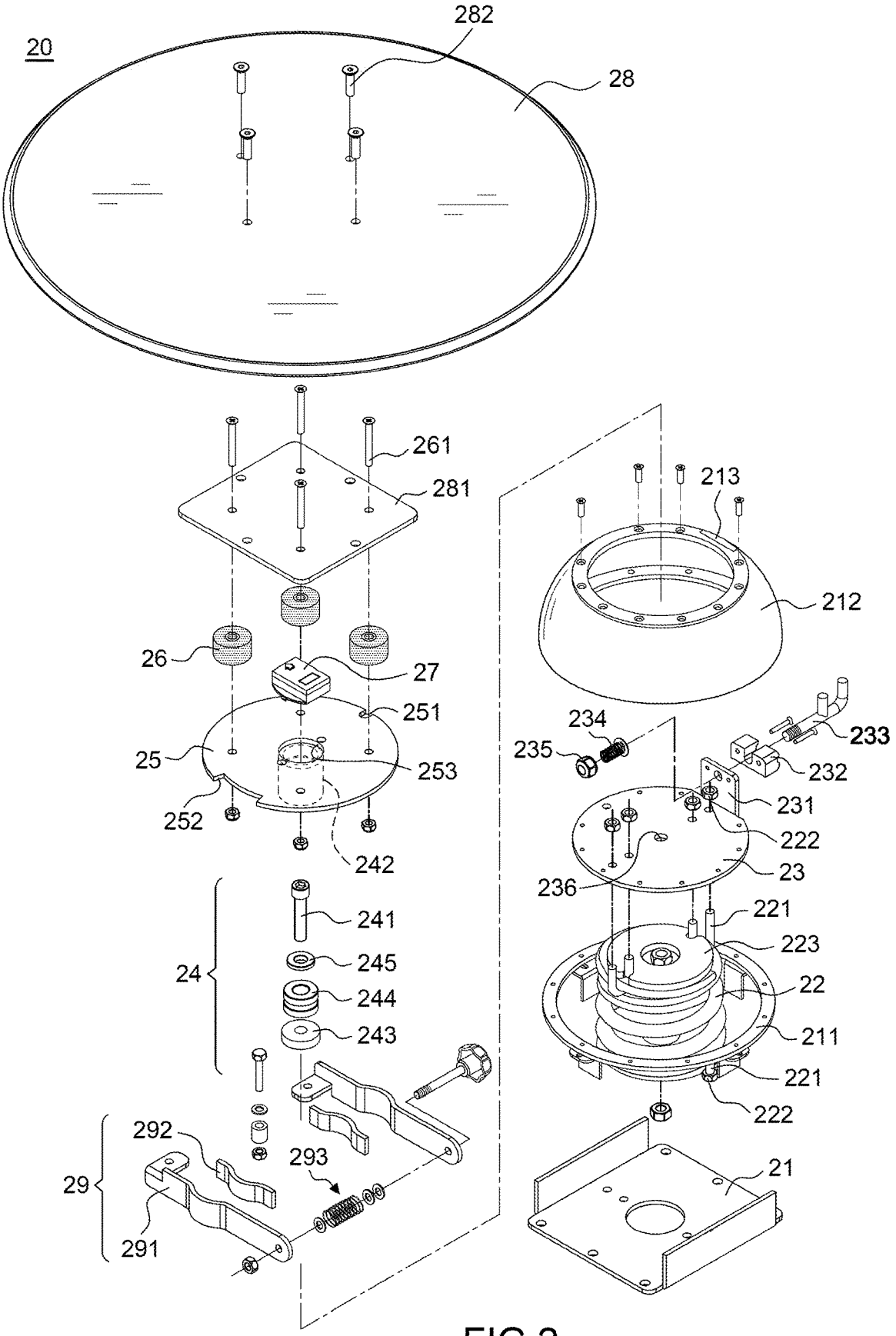
FIG. 2 is an exploded perspective views of the balancing mechanism in the present invention.
Figure 3:
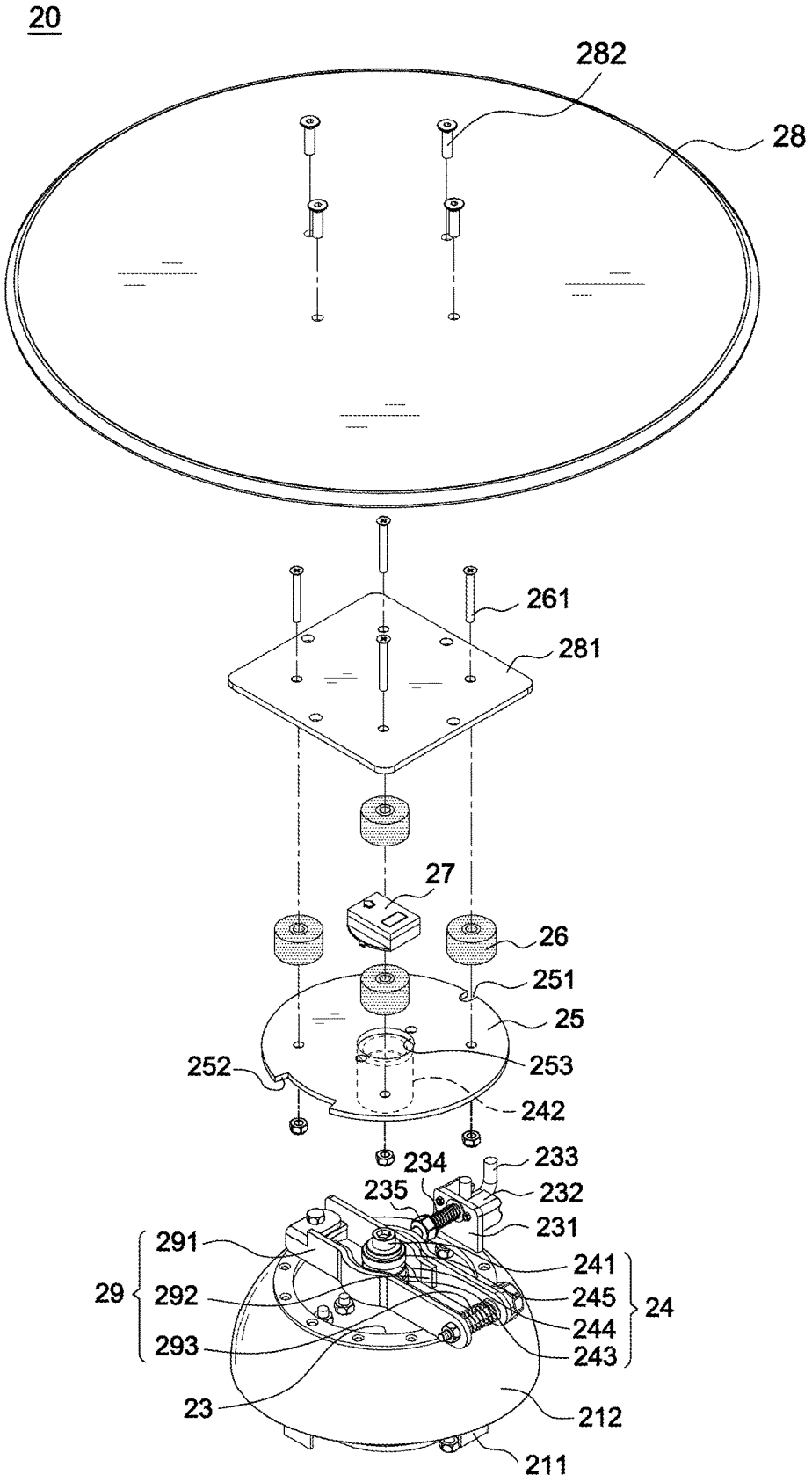
FIG. 3 is an assembly perspective views of partial components the balancing mechanism.

Referring to FIGS. 2-3, in the present invention, the balancing mechanism includes a fixing base 21 arranged on the base frame 11; by two inverted ∪-shaped bolt 221 and a bolt nut 222 fixed a spring 22 on the fixing base 21; in the present invention, to prevent the spring 22 from accidently hurting people, a bottom shell 211 and a top shell 212 is locked together to cover the spring 22 inside, and the bottom shell 211 is fixed on the base frame 11 to increase firmness; a lower supporting plate 23 arranged on the top of the spring 22, a cover plate 223 placed in the middle to distribute stress uniformly on the spring 22, by two inverted ∪-shaped bolt 221 and the spring 22 fixed the lower supporting plate 23 on the lower edge, a inserting slot 231 upward extended to the upper edge is embedded bottom-up into a locating slot 213 of the top shell 212, and use multiple screw to fix the lower supporting plate 23 to the inner side of the top shell 212; a pivoting center mechanism 24 has a fixing component 241, the pivoting center mechanism 24 is set through the center of the lower supporting plate 23 and fixed by the bolt nut 235, at the outer edge the fixing component 241 have an axle seat 243, an axle bush 244, and a washer 245, a pivot hinge 242 arranged at the outer edge of the axle bush 244 and is pivotable; an upper supporting plate 25 with a connected hole 253 is arranged at the outer edge of the pivot hinge 242, and do pivoting relative to the lower supporting plate 23 by the pivoting center mechanism 24.

Figure 4A:
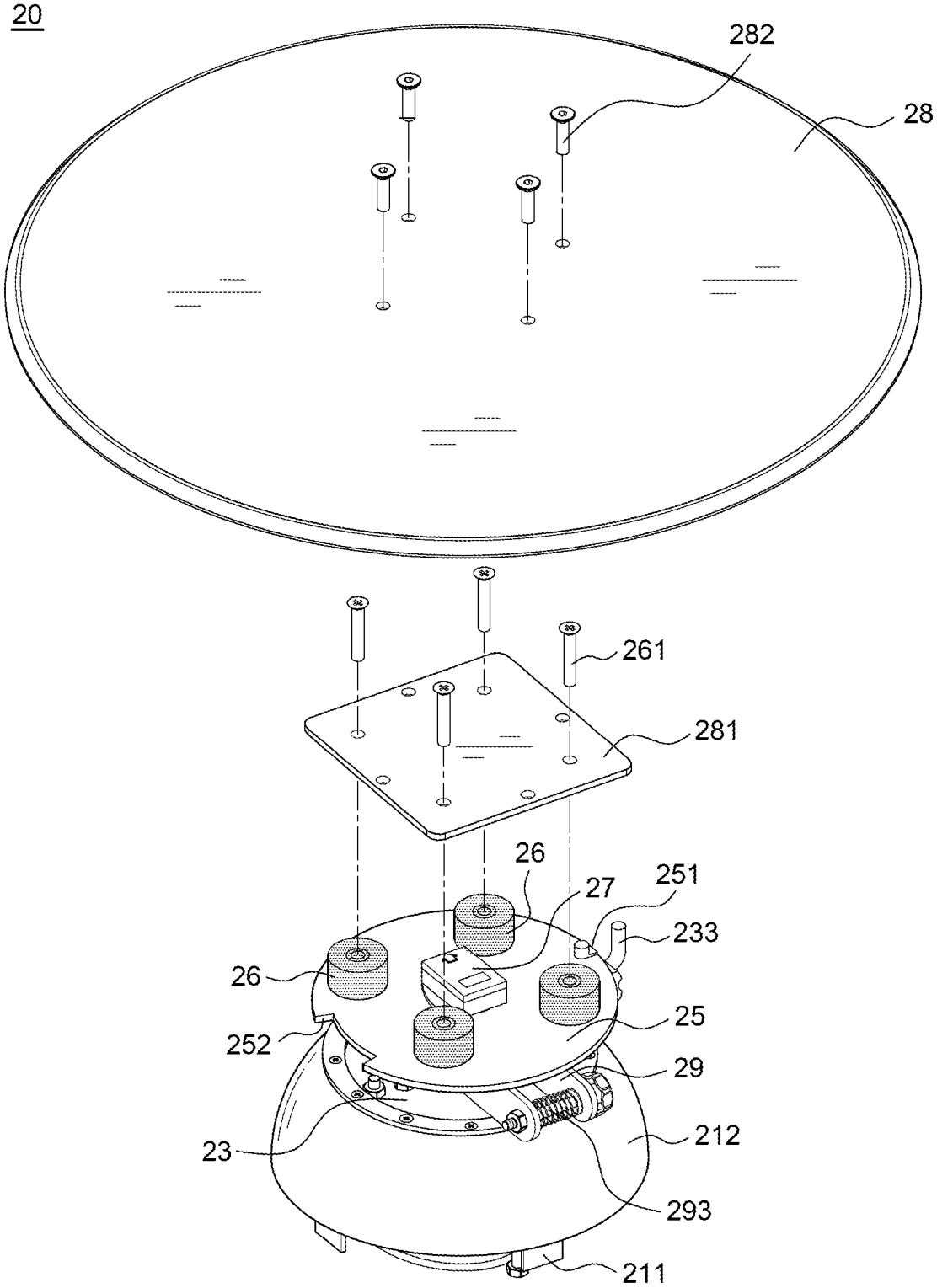
FIG. 4A is a schematic diagram illustrating the position of being fixed of the upper supporting plate of the balancing mechanism.
Figure 4B:
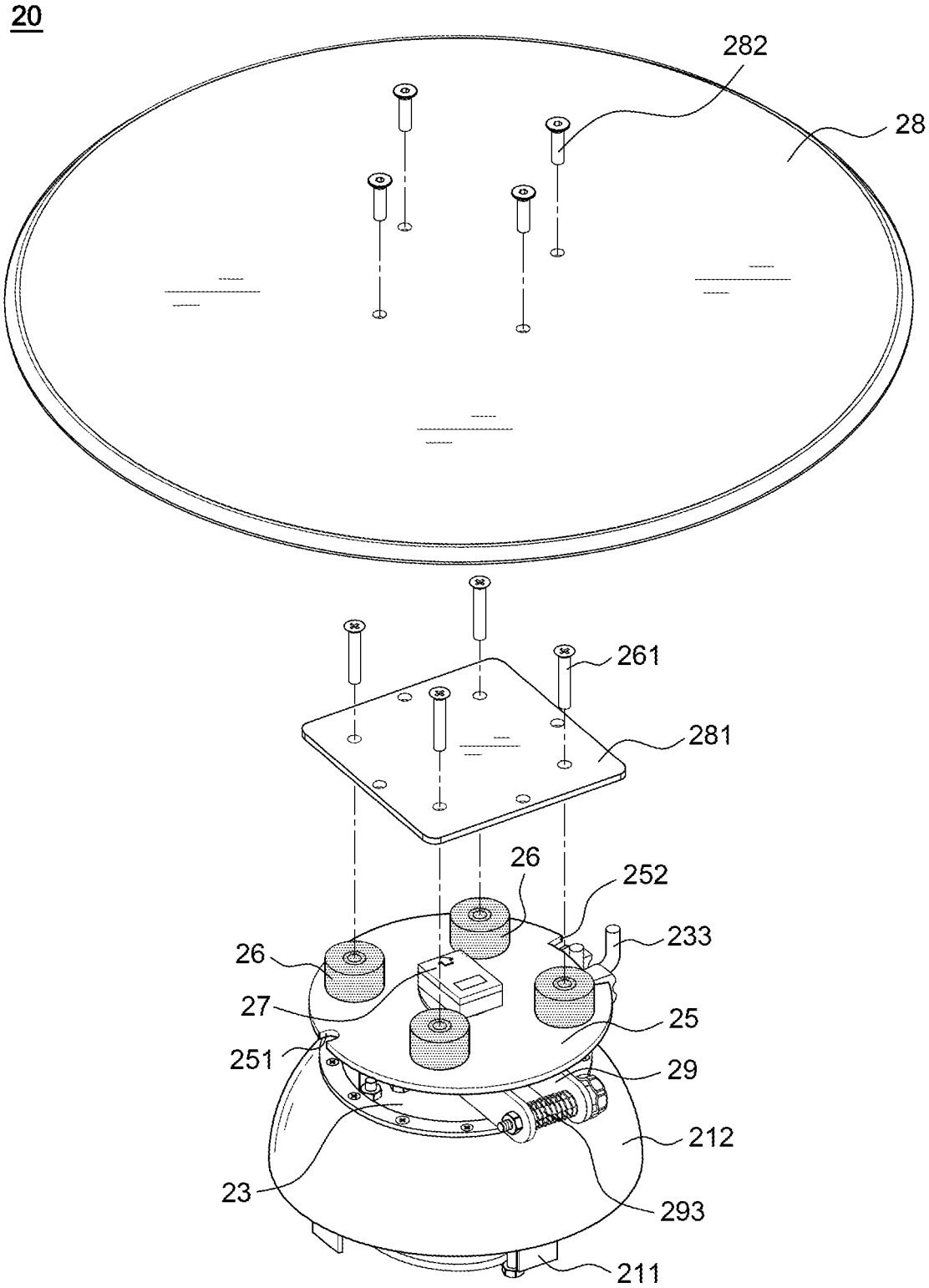
FIG. 4B is a schematic diagram illustrating the position capable of pivoting of the upper supporting plate of the balancing mechanism.
Figure 5:
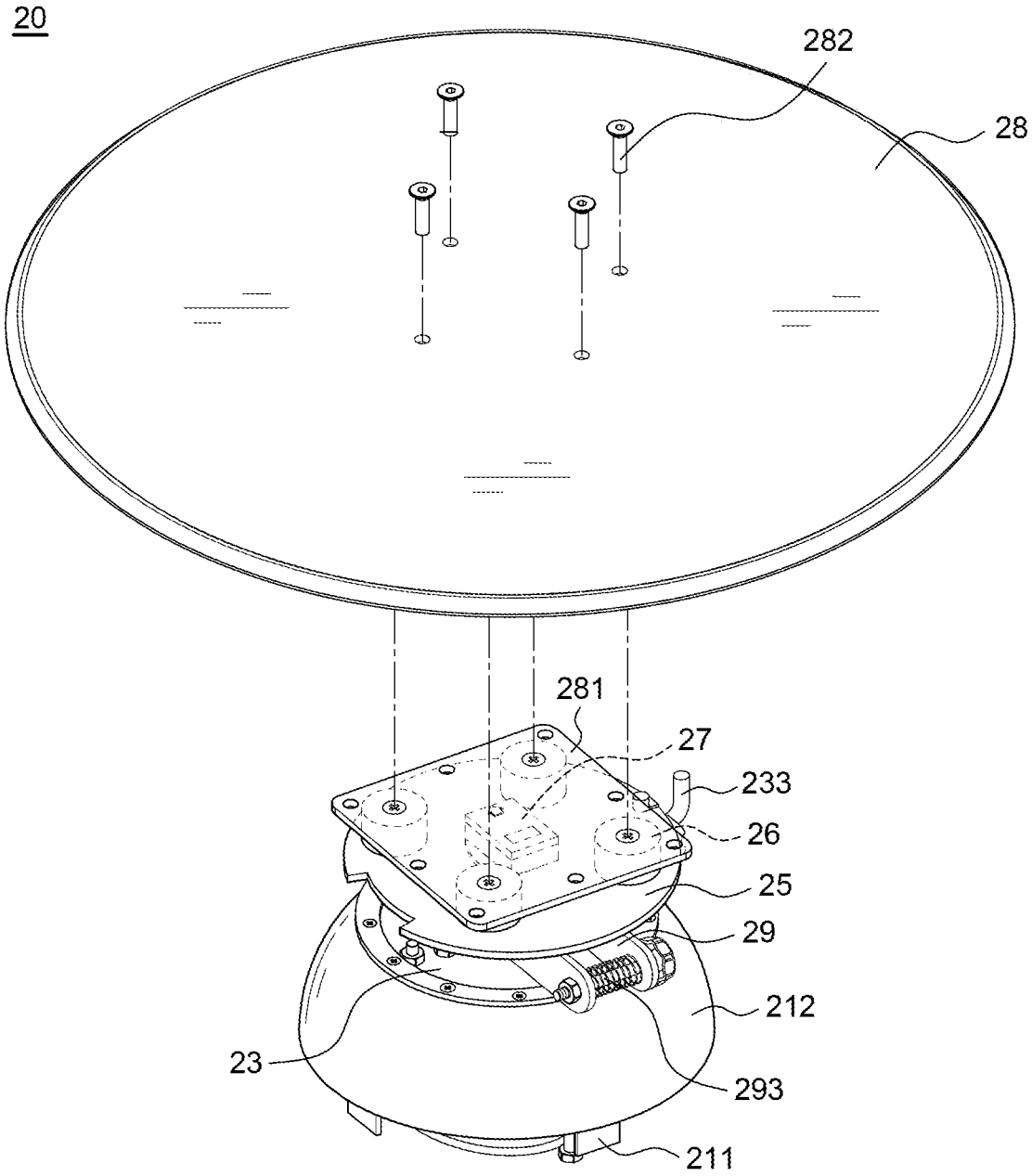
FIG. 5 is an assembly perspective views of partial components the balancing mechanism.
Figure 6:
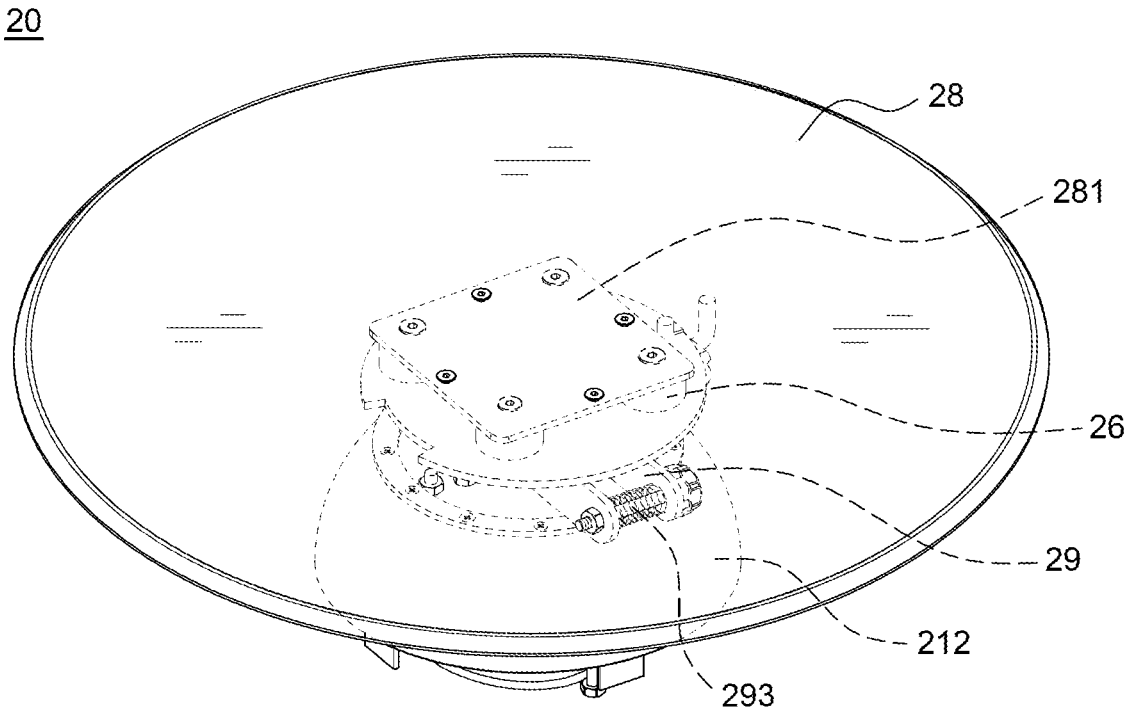
FIG. 6 is an assembly perspective views of the balancing mechanism.

On the outer edge of the upper supporting plate 25 arranged a limit slot 251 and a steering slot 252 arranged 180° apart, the lower supporting plate 23 set a guiding pin 233, which is capable of having radial displacement, by a guide block 232, a small spring 234, a bolt nut 235 which are arranged on the outer side of the inserting slot 231; wherein the width of the limit slot 251 is corresponded to the guiding pin 233, the steering slot 251 has a predetermined angle arc width, since the upper supporting plate 25 is pivoted relatively to the lower supporting plate 23 by the pivoting center mechanism 24, thus the upper supporting plate 25 can be rotated, and embedding the guiding pin 233 to the limit slot 251, then the upper supporting plate 25 can only move up and down by effect of the spring 22 stretched and compressed, but cannot pivot relatively to the lower supporting plate 23, as FIG. 4A shows; pulling the guiding pin 233 outward make it leave away from the limit slot 251, and turning the upper supporting plate 25 make the guiding pin 233 embed to the steering slot 252, not only the upper supporting plate 25 can move up and down by effect of the spring 22 stretched and compressed, but also can relatively pivot the lower supporting plate 23 repeatedly in predetermined angular degree, as 4B shows. In this embodiment, the steering slot 252 angle arc width is about 15° to 30° degree, but the present invention is not limited to such application, that is the steering slot 252 angle arc width can be any between 270° degree.

Referring to FIGS. 2-6, multiple elastic column 26 arranged equiangularly on the upper supporting plate 25, in present invention has four elastic columns 26 but not limited; furthermore, on the top of the elastic column 26 arranged a stress loading plate 281, using bolt 261 to fix multiple elastic column 26 between the stress loading plate 281 and the upper supporting plate 25; a motion-tracking sensor 27 with a build-in signal sensor and transmitter, the motion-tracking sensor 27 arranged at the upper edge of the upper supporting plate 25, and the motion-tracking sensor 27 detects the movement of the upper supporting plate 25; a loading board 28 not limited to the shape of a circle, the loading board 28 needs a bigger area for fitness user to stand on, and fixed by multiple screw 282 on the stress loading plate 281.

The present invention has a damper 29 arrange on the edge of the pivot hinge 242, the damper 29 includes two brake clamps 291, two brake caliper 292, and a pair of adjusters 293, the two brake clamps 291 is fixed on the top shell 212 by the bolt, the two brake calipers 292 arranged inside the brake clamps 291 and cover the damper 29, the adjuster 293 formed by a bolt, a compression spring, a regulating nut, the adjuster 293 arranged at the adjusting side, rotating the bolt nut can adjust the clamping force of the two brake clamps 291 and the two brake calipers 292, then changing the tightness of covering the pivot hinge 242 by the two brake calipers 292, when the upper supporting plate 25 which connected to the loading board 28 rotating repeatedly, the damper 29 create different resistant force to enhance effect of the fitness exercise.

Figure 7:
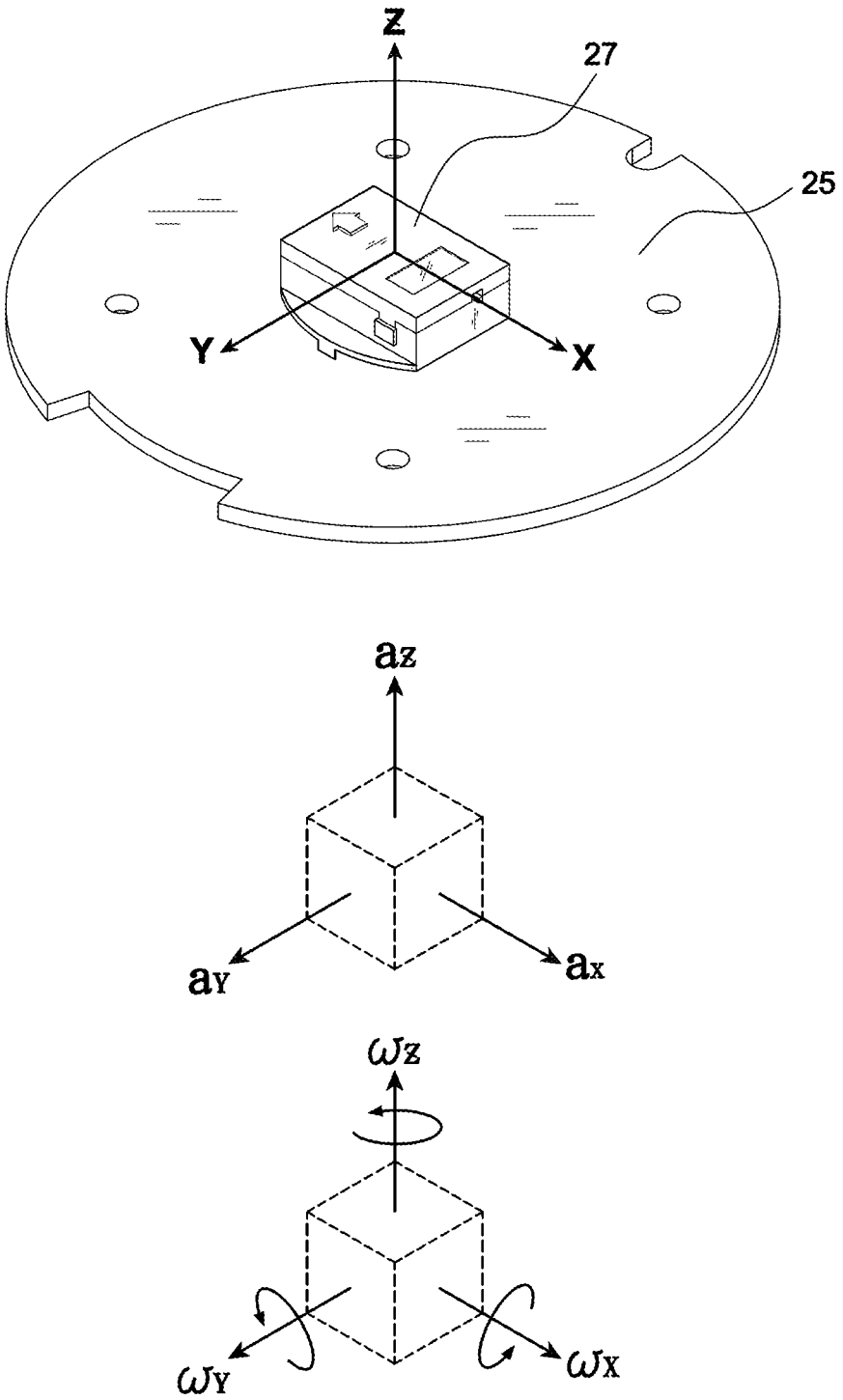
FIG. 7 is a schematic diagram illustrating axial-coordinates of the motion-tracking sensor.
Figure 8:
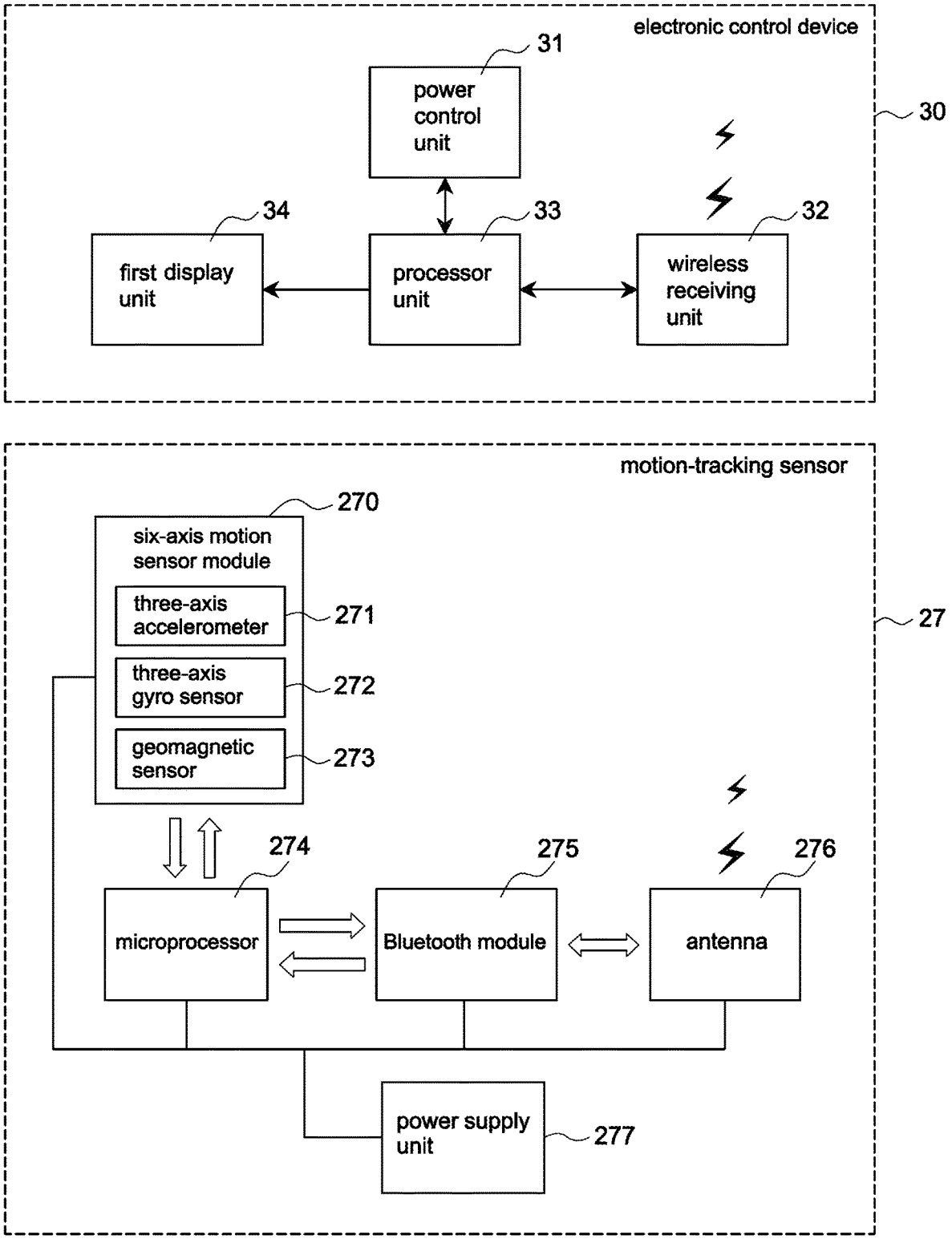
FIG. 8 is the electric circuit block diagram of motion-tracking sensor application in the present invention.

FIGS. 7-8 illustrate the structure of the motion-tracking sensor 27 in present invention, the motion-tracking sensor 27 comprise a three-axis accelerometer 271 and a three-axis gyro sensor 272 to form a six-axis motion sensor module 270 in order to detect the acceleration a and the angular velocity co of the upper supporting plate while oscillating, or add a geomagnetic sensor 273 to form a nine-axis motion sensor module. In the present invention, the six-axis motion sensor module 270 detect the three-axis motion by the three-axis accelerometer 271, which is the signal of the acceleration of exercise, ax, ay, az, and the three-axis gyro sensor detect the three-axis swing motion, which is the signal of the angular velocity of exercise, ωx, ωy, ωz; the geomagnetic sensor 273 detects the direction of geomagnetic to confirm the direction of the upper supporting plate 25 to get the azimuth angle in absolute coordinate system of the upper supporting plate 25; a microprocessor 274 being electrically connected to the six-axis motion sensor module 270, the microprocessor 274 read the magnitude of the acceleration and the angular velocity from the six-axis motion sensor module 270 in fixed time, and after operating, the magnitude become the signal of a motion track; by the acceleration data which the three-axis accelerometer 271 provided, the microprocessor 274 calculate integral of acceleration a over time to get velocity, calculate integral of velocity over time to get displacement, and by the angular velocity data which the three-axis gyro sensor 272 provided, the microprocessor 274 calculate the differential and the integral of the angular velocity ω to get angular acceleration and angle of rotation; a Bluetooth module 275 transmitting the signal of the motion track arranged inside the motion tracking sensor 27, electrically connected to the microprocessor 274, and coupled to an antenna 276; furthermore, the motion tracking sensor 27 include a power supply unit 277 to provide the power source for the units inside the motion tracking sensor 27, in this embodiment, the power supply unit 277 can be a battery, a charging circuit or a socket.

The electronic control device 30 comprises a power control unit 31 to control power supplying, a wireless receiving unit 32, to receive the motion track signal from the Bluetooth module 275 and the antenna 276; a processor unit 33 loaded with motion sensor game program with default motion track data, the default motion track data is divide into the velocity, the displacement, the angular velocity, the angle of rotation, and compare the default motion track data with received data; a first display unit 34 connected to the processor unit 33, by comparing the upper supporting plate 25 motion track data with the default motion track data get the position of error, and present the data on the first display unit 34 with comparison of patterning track, and achieve effect of presenting imitating image of the motion sensor game.

Figure 9:
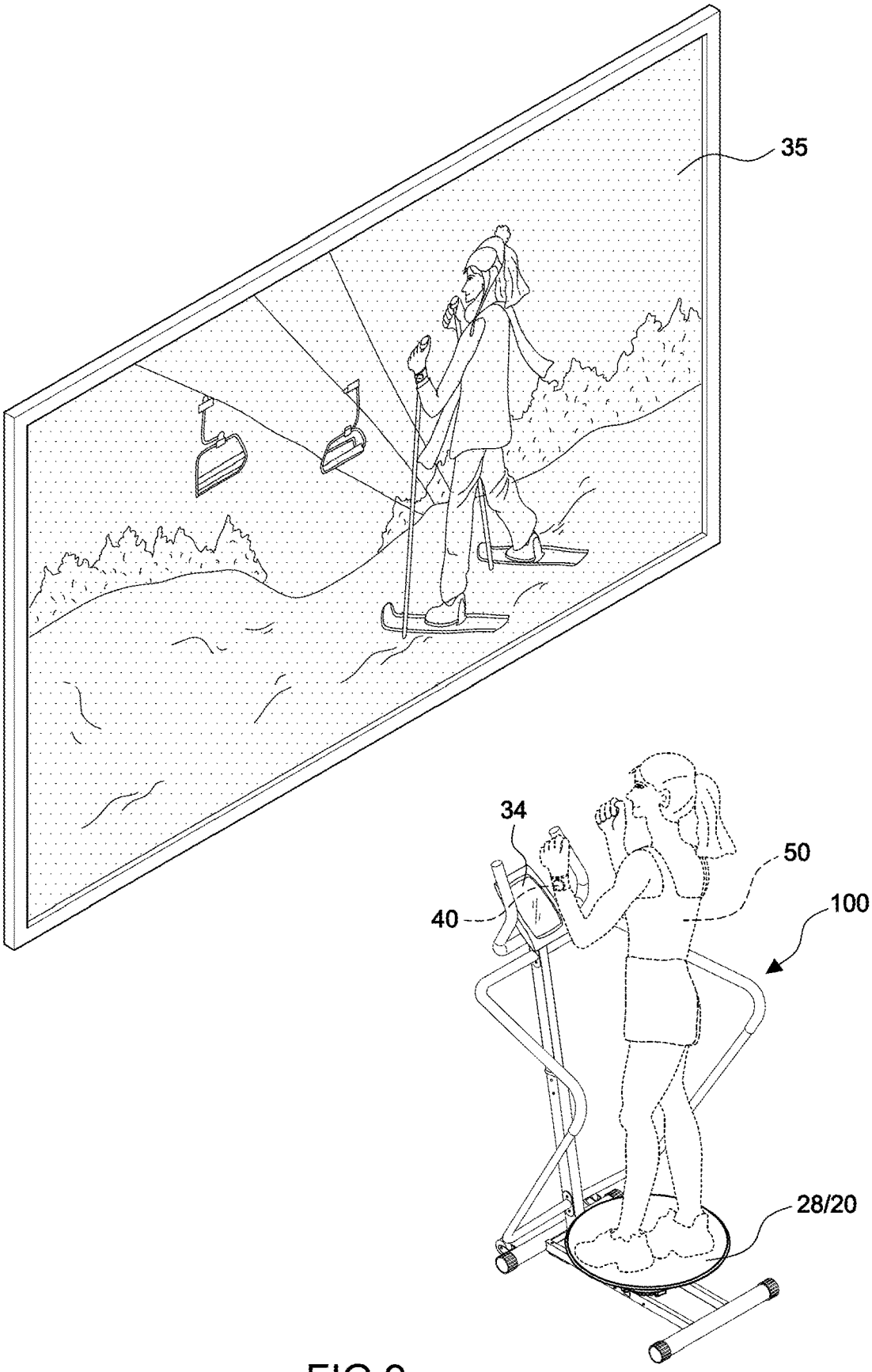
FIG. 9 is the embodiment of presenting virtual reality effect in the present invention.

FIG. 9 illustrates the embodiment of the virtual reality effect of the multifunctional balance exercise machine 100 in present invention, wherein, the multifunctional balance exercise machine 100 comprises a wearable 40 with a motion tracking sensor 27 for fitness user's wrist, and a second display unit 35, which is a big monitor screen hanging on the wall, connected to a first display unit 34 of an electronic control device 30 to have multiple displays, whereby when the fitness user 50 stand on the loading board 28, the user body weight and the stress applied by feet transmit to the elastic column 26 and the spring 22 via the loading board 28, cause the elastic column 26 and spring 22 compressed or stretched, and force the loading board 28 to oscillate then achieve the effect of balance exercise; furthermore, the motion tracking sensor 27 transmit signal of oscillation data to the wireless receiving unit 32, the processor unit 33 operate the data, and present the image of the motion sensor game via the first display unit 34 and the second display unit 38 to achieve entertaining effect of virtual reality game.

In the present invention, the balancing mechanism 20 includes the loading board 28, under the loading board 28 arranged spring 22 and multiple elastic column 26; the fitness user 50 needs to apply stress and weight on the loading board 28 to keep in balance, by affect from the compressed or stretched of the multiple elastic column 26, provide flexibility for loading board 28 to do torsional movement, and improve the effect of imitating skiing or surfing. In the present invention, on the edge of the upper supporting plate 25 of the balancing mechanism 20 arrange a limit slot 251 and a steering slot 252 arranged 180° apart from each other, on the lower supporting plate 23 set a guiding pin 233, which is capable of having radial displacement, the fitness user 50 can either embed the guiding pin 233 to the limit slot 251 to stop the upper supporting plate 25 and the lower supporting plate 23 from pivoting, and achieve the effect of simulating the up and down motion of the surfing, or embed the guiding pin 233 to the steering slot 252 to have the upper supporting plate 25 and the lower supporting plate 23 pivoting repeatedly in predetermined angular degree, and achieve the effect of simulating the up and down and oscillating motion of the skiing. Furthermore, in the present invention, on the lower edge of the upper supporting plate 25 of the balancing mechanism 20 set a motion-tracking sensor 27 with build-in signal controlling and transmitting device, on the handle 14 set an electronic control device 30, the electronic control device 30 includes a power control unit 31, a first display unit 34, a wireless receiving unit 32 and a processor unit 33 loaded with motion sensing game program; therefore, when the fitness user 50 do balance exercise on the loading board, the motion tracking sensor 27 transmit the signal of the oscillation data to t the processor unit 33 to operate the data, and present the image of the motion sensor game via the first display unit 34 to achieve entertaining effect of virtual reality game.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multifunctional balance exercise machine, comprising:

an exercise equipment with a base frame;

a balancing mechanism including a fixing base, a spring, a lower supporting plate, an upper supporting plate, plural elastic columns, a stress loading plate, a motion-tracking sensor, and a loading board;

wherein the fixing base is fixed on the base frame, a bottom of the spring is fixed on the fixing base, the lower supporting plate installed at a top of the spring, the upper supporting plate is fixed to the lower supporting plate by a pivoting center mechanism, and the plural elastic columns arranged between the stress loading plate and the upper supporting plate, the motion-tracking sensor arranged on a top edge of the upper supporting plate has a sensor and transmitter built-in, the loading board is fixed on a top of the stress loading plate;

wherein a guiding pin is set on the lower supporting plate which is capable of having radial displacement on the lower supporting plate, a limit slot and a steering slot are respectively formed in an edge of the upper supporting plate 180° apart from each other, embedding the guiding pin to the limit slot stops the upper supporting plate and the lower supporting plate from pivoting, and embedding the guiding pin to the steering slot causes the upper supporting plate and the lower supporting plate to pivot repeatedly in a predetermined angular degree;

an electronic control device set on the exercise equipment including a power control unit, a first display unit, and a processor unit loaded with a program for a motion sensing game;

whereby when a fitness user stands on the loading board, the user's body weight and a stress applied by feet transmit to the plural elastic column and the spring via the loading board, causes the plural elastic columns and the spring to be compressed or stretched, and force the loading board to oscillate to achieve the effect of a balance exercise; furthermore, the motion-tracking sensor transmits a signal of oscillation data a wireless receiving unit, the processor unit uses the oscillation data, and presents an image of the motion sensing game via the first display unit to achieve an entertaining effect of a virtual reality game.

2. The multifunctional balance exercise machine as claimed in claim 1, wherein the motion-tracking sensor includes a three-axis accelerometer, a three-axis gyro sensor, forming a six-axis motion sensor module in order to detect acceleration and angular velocity of the oscillating upper supporting plate while oscillating, the six-axis motion sensor module detects a three-axis motion by the three-axis accelerometer, which is a signal of acceleration of exercise, the three-axis gyro sensor detects a three-axis swing motion, which is a signal of angular velocity of exercise.

3. The multifunctional balance exercise machine as claimed in claim 2, wherein the motion-tracking sensor includes a geomagnetic sensor, forming a nine-axis motion sensor module, the geomagnetic sensor detects a direction of a geomagnetic field to confirm the direction of the upper supporting plate to get an azimuth angle in absolute coordinate system of the upper supporting plate; a microprocessor electrically connected to the six-axis motion sensor module, the microprocessor read the magnitude of the acceleration and the angular velocity from the six-axis motion sensor module in fixed time, and after operating, these magnitudes become a signal of a motion track; using the acceleration data which the three-axis accelerometer provided, the microprocessor calculates an integral of acceleration over time to get velocity, calculates an integral of velocity over time to get displacement, and by using the angular velocity data which the three-axis gyro sensor provides, the microprocessor calculates the differential and the integral of the angular velocity to get angular acceleration and angle of rotation; a Bluetooth module transmitting the signal of the motion track arranged inside the motion-tracking sensor, electrically connected to the microprocessor, and coupled to an antenna.

4. The multifunctional balance exercise machine as claimed in claim 3, wherein the motion-tracking sensor includes a power supply unit to provide a power source for the units inside the motion-tracking sensor.

5. The multifunctional balance exercise machine as claimed in claim 1, wherein the pivoting center mechanism includes a fixing component arranged at the lower supporting plate, an axle seat at an outer edge of the fixing component, an axle bush, and a washer, a pivot hinge arranged at an outer edge of the axle bush makes the upper supporting plate pivot and be fixed on the pivot hinge; on an outer edge of the pivot hinge is a damper applying resistance force to the upper supporting plate while pivoting.

6. The multifunctional balance exercise machine as claimed in claim 5, wherein the damper includes two brake clamps, two brake calipers, and an adjuster, the two brake clamps arranged on the lower supporting plate, the two brake calipers arranged inside of the two brake clamps and covering the pivot hinge, the adjuster arranged on the two brake clamps, adjusting the two brake clamps to change tightness of the two brake calipers produces a different resistance force while the upper supporting plate is pivoting.

7. A multifunctional balance exercise machine, comprising:

an exercise equipment with a base frame;

a balancing mechanism including a fixing base, a spring, a lower supporting plate, an upper supporting plate, plural elastic columns, a stress loading plate, a motion-tracking sensor, and a loading board;

wherein the fixing base is fixed on the base frame, a bottom of the spring is fixed on the fixing base, the lower supporting plate installed at a top of the spring, the upper supporting plate is fixed to the lower supporting plate by a pivoting center mechanism, and the plural elastic columns arranged between the stress loading plate and the upper supporting plate, the motion-tracking sensor arranged on a top edge of the upper supporting plate has a sensor and transmitter built-in, the loading board is fixed on a top of the stress loading plate;

an electronic control device set on the exercise equipment including a power control unit, a first display unit, and a processor unit loaded with a program for a motion sensing game, the motion-tracking sensor including a three-axis accelerometer, a three-axis gyro sensor, forming a six-axis motion sensor module in order to detect acceleration and angular velocity of the oscillating upper supporting plate while oscillating, the six-axis motion sensor module detects a three-axis motion by the three-axis accelerometer, which is a signal of acceleration of exercise, the three-axis gyro sensor detects a three-axis swing motion, which is a signal of angular velocity of exercise;

whereby when a fitness user stands on the loading board, the user's body weight and a stress applied by feet transmit to the plural elastic column and the spring via the loading board, causes the plural elastic columns and the spring to be compressed or stretched, and force the loading board to oscillate to achieve the effect of a balance exercise;

furthermore, the motion-tracking sensor transmits a signal of oscillation data to a wireless receiving unit, the processor unit uses the oscillation data, and presents an image of the motion sensing game via the first display unit to achieve an entertaining effect of a virtual reality game.

8. The multifunctional balance exercise machine as claimed in claim 7, wherein the motion-tracking sensor includes a geomagnetic sensor, forming a nine-axis motion sensor module, the geomagnetic sensor detects a direction of a geomagnetic field to confirm the direction of the upper supporting plate to get an azimuth angle in absolute coordinate system of the upper supporting plate; a microprocessor electrically connected to the six-axis motion sensor module, the microprocessor read the magnitude of the acceleration and the angular velocity from the six-axis motion sensor module in fixed time, and after operating, these magnitudes become a signal of a motion track; using the acceleration data which the three-axis accelerometer provided, the microprocessor calculates an integral of acceleration over time to get velocity, calculates an integral of velocity over time to get displacement, and by using the angular velocity data which the three-axis gyro sensor provides, the microprocessor calculates the differential and the integral of the angular velocity to get angular acceleration and angle of rotation; a Bluetooth module transmitting the signal of the motion track arranged inside the motion-tracking sensor, electrically connected to the microprocessor, and coupled to an antenna.

9. The multifunctional balance exercise machine as claimed in claim 8, wherein the motion-tracking sensor includes a power supply unit to provide a power source for the units inside the motion-tracking sensor.

* * * * *